United States Patent [19]

Terada et al.

[11] Patent Number: 4,916,779

[45] Date of Patent: Apr. 17, 1990

[54] ADJUSTABLE FASTENER

[75] Inventors: Yasuharu Terada, Uozu; Yukio Shimada, Osaka; Yoshiyuki Horita, Toyama, all of Japan

[73] Assignee: Yoshida Kogyo K. K., Tokyo, Japan

[21] Appl. No.: 357,606

[22] Filed: May 26, 1989

[30] Foreign Application Priority Data

May 31, 1988 [JP] Japan ..... 63-135133

[51] Int. Cl.[4] ..... A41F 1/00; A44B 11/10

[52] U.S. Cl. ..... 24/585; 24/171; 24/194

[58] Field of Search ..... 24/585, 170, 171, 194, 24/581, 582, 583, 584, 586, 633

[56] References Cited

U.S. PATENT DOCUMENTS

| | | | |
|---|---|---|---|
| 1,786,943 | 12/1930 | Gammell | 24/585 |
| 1,838,463 | 12/1931 | Statham | 24/585 |
| 1,910,891 | 5/1933 | Freysinger | 24/585 |
| 2,615,218 | 10/1952 | Ross | 24/194 |
| 4,534,087 | 8/1985 | Lau | 24/171 |

FOREIGN PATENT DOCUMENTS

| | | |
|---|---|---|
| 53-32289 | 9/1978 | Japan . |
| 54-88439 | 7/1979 | Japan . |
| 62-33882 | 7/1987 | Japan . |

*Primary Examiner*—Victor N. Sakran

*Attorney, Agent, or Firm*—Hill, Van Santen, Steadman & Simpson

[57] ABSTRACT

An adjustable fastener for interconnecting a first and a second part of an article includes a flat hollow sleeve having a first connecting portion for attachment to the first part, a plug having a second connecting portion for attachment to the second part, a flat body slidably received in a longitudinal guide channel in the sleeve, a locking member slidably held within a transverse guide groove in the sleeve and having a pusher head at an end thereof, and at least one locking projection releasably engageable with one of a row of teeth on the plug body for locking the plug in position against displacement, and a spring held within the sleeve for normally retaining the locking projection in locking engagement with the one tooth and keeping the pusher head to project outwardly of the sleeve. The locking member is movable along the guide groove to disengage the locking projection from the one tooth against the force of the spring when the pusher head is depressed.

17 Claims, 5 Drawing Sheets

ADJUSTABLE FASTENER

BACKGROUND OF THE INVENTION

1. Field of the Invention

The present invention relates to an adjustable fastener for use on a garment such as a pair of trousers, skirt, jacket or the like, a bag, a cap or the other article for adjustably fastening loose ends of the article or loose ends of a strap attached to the article.

2. Description of the Prior Art

Various adjustable fasteners are known in the art which are attached to garments, bags, caps or other articles for adjustably connecting loose ends of the respective articles. One prior adjustable fastener is shown in Japanese Patent Publication No. 62-33882. The disclosed adjustable fastener is composed of a toothed rail or rack secured to one loose end of a pair of trousers, and a slider connected to the other loose end of the trousers and slidably mounted on the rack, the slider being releasably lockable at a desired position on the rack. This adjustable fastener is defective from the aesthetic view because the rack is exposed to the view.

Japanese Patent Publication No. 53-32289 and Japanese Patent Laid-open Publication No. 54-88439 disclose adjustable fasteners of the type which comprise a cover strip overlying a rack, and a slider slidably movable on and along the rack without interference with the cover strip and releasably lockable at a desired position on the rack. The slider includes an outwardly extending flap lever having an opening through which the cover strip extends, so that the rack and the slider are concealed by the cover strip except the flap lever. The substantially concealed adjustable fastener is sightly in appearance and the exposed flap lever provides an improved maneuverbility of the adjustable fastener. The adjustable fastener is however relatively thick or high in profile because of the presence of the cover strap. Yet, the cover strap is susceptible to abrasive wear due to frictional engagement with the flap lever when the slider moves along the rack. Another difficulty is found that since the flap lever is stamped from sheet metal into a bent or curved shape and since it is difficult to be detached from the garment, the flap lever is likely to be deformed or broken when subjected to force or pressure during ironing of the garment.

SUMMARY OF THE INVENTION

With the foregoing difficulties in view, it is an object of the present invention to provide an adjustable fastener which is sightly in appearance per se and hence obviates the need for a cover strip, which is rigid enough to withstand force or pressure applied during ironing of an article to which the adjustable fastener is attached, which is low in profile, and which can be manipulated with utmost ease.

Briefly stated, an adjustable fastener according to the present invention is of the buckle type which is composed of male and female members coupled together and adjustably movable relative to one another.

According to the present invention, there is provided an adjustable fastener for interconnecting a first part and a second part, comprising: a flat hollow sleeve having a longitudinal guide channel extending from an end of the sleeve, a guide groove extending transversely of and opening to the guide channel, and a first connecting portion for attachment to the first part; a plug having a flat body slidably receivable in the guide channel, at least one row of teeth disposed on and extending along a longitudinal edge of the body, and a second connecting portion disposed at an end of the body for attachment to the second part; a locking member slidably held within the guide groove and having a pusher head at an end thereof, and at least one locking projection releasably engageable with one of the teeth on the plug body for locking the plug in position against displacement; and spring means held within the sleeve for normally retaining the locking projection in locking engagement with said one of the teeth and keeping the pusher head to project outwardly of the sleeve, the locking member being movable along the guide groove to disengage the locking projection from said one of the teeth against the force of the spring means when the pusher head is depressed.

In use, the adjustable fastener is attached to a garment such as a pair of trousers by connecting the connecting portion of the sleeve and the connecting portion of the plug, respectively, to loose ends of a waistband of the trousers. When the adjustment of the effective length of the waistband is necessary, the pusher head of the locking member is depressed by the user's finger to move the locking member in a direction to disengage the locking projection from one of the teeth on the plug against the force of the spring means. While keeping the depressed condition of the pusher head, the plug is moved along the guide channel toward a desired position. Upon arrival of the plug at the desired position, the locking member is released, whereupon the locking projection is returned to its normal position under the force of the spring means. Thus, the locking projection again engages the one tooth on the plug, hereby holding the plug in the desired position.

According to a preferred embodiment, the teeth on the plug comprises saw-teeth and the locking projection on the locking member comprises a saw tooth complementary in contour to the saw-teeth on the plug. One of the sleeve and the plug may has a guide recess extending parallel to the direction of movement of said plug, the other of the sleeve and the plug includes a stopper projection slidably received in the guide recess for holding the sleeve and the plug in an assembled condition against accidental detachment. According to another preferred embodiment, the plug may further includes an additional row of teeth disposed on and extending along an opposite longitudinal edge of the plug body, and the locking member has an additional pusher head at an opposite end thereof, and at least one additional locking projection releasably engageable with one of the additional teeth, in which instance the spring means is disposed to act between the sleeve and the locking member for urging the latter in a direction to retain the additional locking projection into locking engagement with said one of the additional teeth and keep the additional pusher head to normally project outwardly of the sleeve.

DETAILED DESCRIPTION

Figure 1:
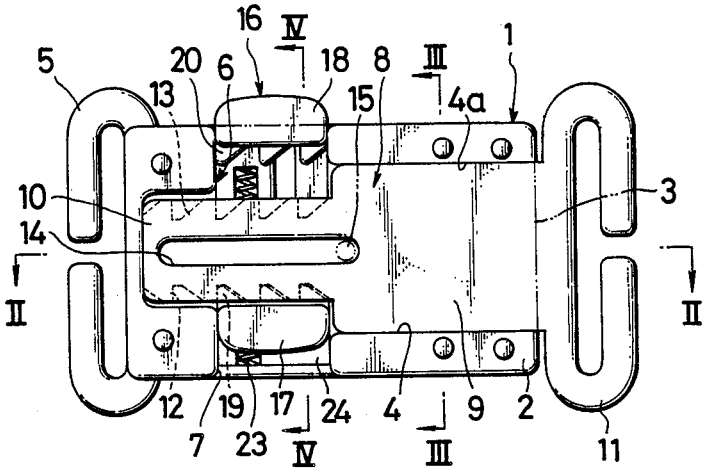
FIG. 1 is a bottom view of an adjustable fastener according to the invention, with a back plate removed for showing the inside of the adjustable fastener.
Figure 2:
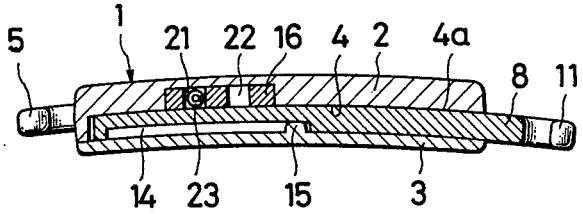
FIG. 2 is a cross-sectional view taken along line II—II of FIG. 1.
Figure 3:
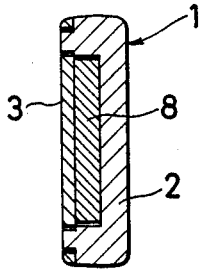
FIG. 3 is a cross-sectional view taken along line III—III of FIG. 1.

The present invention will be described hereinbelow in greater detail with reference to certain preferred embodiments shown in the accompanying drawings. Like reference characters denote like or corresponding parts throughout several views.

As shown in FIGS. 1 through 6, an adjustable fastener according to the present invention is of the form of an adjustable buckle composed of male and female members coupled together. The female member of the adjustable buckle is composed of a flat hollow socket or sleeve 1 of a substantially rectangular shape having a longitudinal guide channel 4 extending from an end of the sleeve 1 and terminating short of an opposite end of the sleeve 1. The sleeve 1 is composed of a recessed rectangular top plate 2 and a flat rectangular back plate 3 assembled with the top plate 2 to close a recessed side of the top plate 2. The top plate 2 has a longitudinal recess substantially constituting the guide channel 4, and a transverse guide groove 6 extending perpendicular to and opening toward the longitudinal guide channel 4. The sleeve 1 further has a connecting portion 5 integrally formed with the top plate 2 at the opposite end of the sleeve 1, and a pair of openings 7 contiguous to opposite ends, respectively, of the transverse guide groove 6.

The male member of the adjustable buckle comprises a flat plug 8 coupled with the sleeve 1. The plug 8 includes a substantially rectangular body 9, a narrow locking leg 10 extending from an end of the body 9, and a connecting portion 11 at an opposite end of the body 9. The locking leg 10 and the body 9 are slidably received in the guide channel 4 in the sleeve 1 while the C-shaped ring connector 11 is disposed outside the sleeve 1. The plug 8 further has a pair of rows of first and second teeth 12, 13 disposed on and extending along opposite longitudinal edges of the locking leg 10. The first and second teeth 12, 13 are in the form of saw-teeth each having a straight edge extending transverse to the locking leg 10 and facing toward the connecting portion 11, and an inclined edge facing away from the connecting portion 11. The first and second teeth 12, 13 are not used at the same time, but either one of them is used depending upon selection determined by the mode of attachment of the adjustable fastener to an article, as described later on. It is therefore possible to omit one row of saw-teeth 12 or 13 when the mode of attachment of the adjustable fastener is fixed.

The plug 8 has in its underside an elongate longitudinal recess 14 in which a stopper projection 15 on an inner surface of the back plate 3 is received for holding the plug 8 in position against accidental removal from the sleeve 1. The recess 14 and the stopper projection 15 may be omitted when the sleeve 1 and the plug 8 are releasably coupled together.

In the illustrated embodiment, the connecting portions 5, 11 of the sleeve 1 and the plug 8 are formed of generally C-shaped ring connectors. The C-shaped ring connectors 5, 11 may be replaced with O-ring connectors.

The illustrated adjustable buckle is used on a pair of trousers for adjusting connecting loose end of a waistband to adjust the effective length of the waistband, so that the sleeve 1 and the plug 8 are bent or curved so as to substantially conform to a curve of the waistband when the user wears the trousers.

Figure 4:
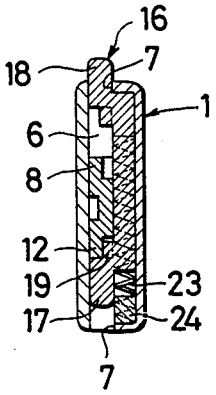
FIG. 4 is a cross-sectional view taken along line IV—IV of FIG. 1.
Figure 5A:
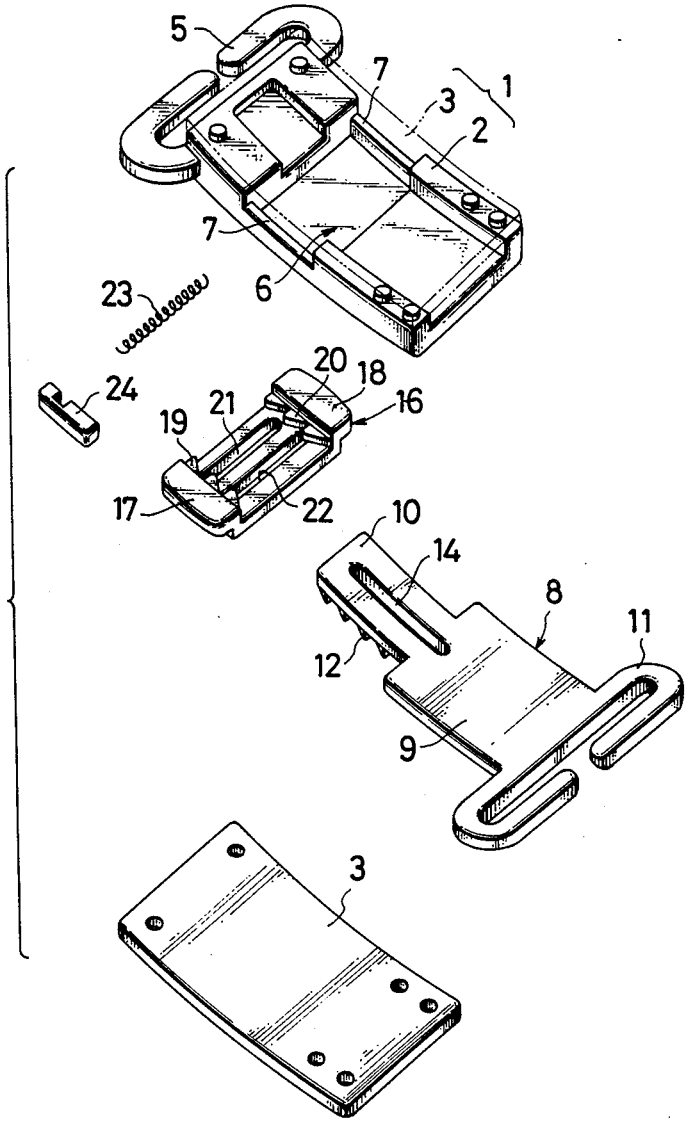
FIG. 5A is an exploded perspective view of the adjustable fastener.
Figure 5B:
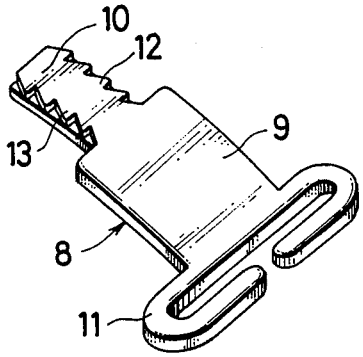
FIG. 5B is a perspective view of a male member or plug of the adjustable fastener as it is viewed from the top of the adjustable fastener.
Figure 6:
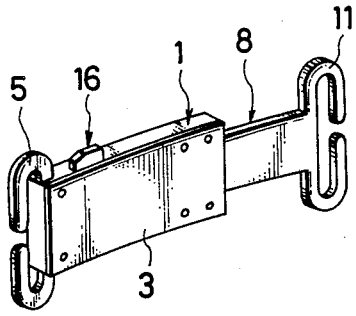
FIG. 6 is a perspective view of the adjustable fastener, with male and female members coupled together.

The adjustable buckle further includes a locking member 16 slidably received within the guide groove 6 and movable in a direction perpendicular to the direction of movement of the plug 8. The locking member 16 has a hat-like shape in cross section and has a pair of pusher heads 17, 18 at opposite ends thereof, as shown in FIG. 4. The locking member 16 is disposed astride the locking leg 10 of the plug 8, with the pusher heads 17, 18 disposed in registry with the respective openings 7 in the sleeve 1. The locking member 16 further has a pair of rows of first and second locking projections 19, 20 disposed on and along confronting inner edges of the respective pusher heads 17, 18 for locking engagement with the teeth 12, 13 on the plug 8. The locking projections 19, 20 comprise saw teeth complementary in shape with the sew-teeth 12, 13 on the plug 8. The locking member 16 further has a pair of parallel spaced longitudinal recesses 21, 22 extending from opposite ends in staggered relation to one another. A compression coil spring 23 is disposed in the recess 21 and acts between the sleeve 1 and the locking member 16 for urging the latter in a direction to retain the locking saw-teeth 19 in locking engagement with the saw-teeth 12 on the plug 8. In this locking position, the pusher head 18 projects from the corresponding opening 7 to the outside of the sleeve 1.

Likewise the one saw-teeth 12 or 13 on the plug 8 and the one locking saw-teeth 19 or 20 on the locking member 16, one of the opening 7 in the sleeve 1 and the one of the recesses 21 or 22 in the locking member 16 can be omitted depending on the mode of application of the adjustable buckle.

When the pusher head 18 is depressed against the force of the spring 23, the locking saw-teeth 19 are released from the locking engagement with the saw-teeth 12 of the plug 8, thereby allowing sliding movement of the plug 8 along the guide channel 4 in the sleeve 1. A further movement of the locking member 16 causes the locking saw-teeth 20 to be engaged with the saw-teeth 13 on the plug 8, thus preventing movement of the plug 8 relative to the sleeve 1. In order to prevent this undesired engagement between the locking saw-teeth 20 and the saw-teeth 13, there is provided a stopper 24 for limiting the movement of the locking member 16 to a certain predetermined range. The stopper 24 is disposed with the guide groove 6 adjacent to the pusher head 17, as shown in FIG. 4. The stopper 24 thus provided is engageable with the locking member 16 to limit movement of the locking member 16 in a direction opposite to the direction of the force of the spring 23. The stopper 24 may be formed integrally with the sleeve 1 if the adjustable buckle is used in the fixed mode of application in which the pusher head 18 projects outwardly from the sleeve 1. On the other hand, when the adjustable buckle is used in an inverted mode of application in which the pusher head 17 projects outwardly of the sleeve 1, then the stopper 24 is disposed adjacent to the pusher head 18 to limit movement of the locking member 16 within the predetermined range when the pusher head 17 is depressed.

Figure 7:
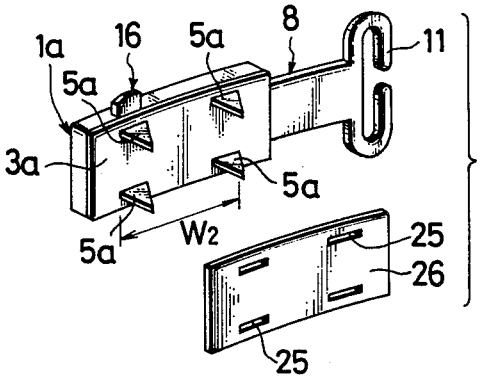
FIG. 7 is a perspective view of a modified adjustable fastener and a retainer associated therewith according to the present invention.
Figure 8:
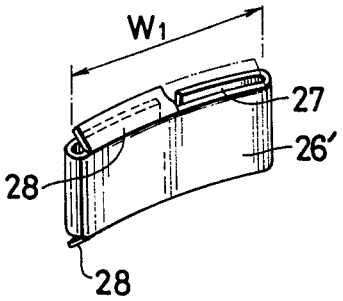
FIG. 8 is a perspective view, with part cut away for clarity, of a modified retainer.
Figure 9:
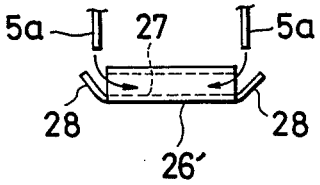
FIG. 9 is an end elevational view of the retainer shown in FIG. 8.

The connecting portion in the form of a C-shaped connector ring 5 may be replaced with a plurality (four in the illustrated embodiment) of prongs 5*a* projecting from a rectangular back plate 3*a* of a sleeve 1*a*, the prongs 5*a* being disposed adjacent to the respective corners of the back plate 3*a*. For attachment of the sleeve 1*a* to an article such as a pair of trousers, the prongs 5*a* pierce the fabric of the trousers and openings 25 in a retainer plate 26 thereon and are clinched to the retainer plate 26. the retainer plate 26 is curved at the same radius of curvature as the back plate 3*a* of the sleeve 1*a*. The retainer plate 26 may be replaced with a flat hollow retainer 26' shown in FIGS. 8 and 9. The hollow retainer 26' is formed from an elongate sheet of metal longitudinally bent or folded over itself with an elongate guide slot 27 defined between upper and lower plates of the folded sheet metal. The retainer 26' includes a pair of inclined guide flaps 28 extending along opposite longitudinal edges of the lower plate and projecting outwardly therefrom for guiding the prongs 5*a* smoothly therealong into the guide slot 27 when the prongs 5*a* are clinched with the retainer 26'. Then, the guide flaps 28 are bent inwardly against the prongs 5*a*. Since the guide slot 27 has a width W1 substantially the same as or slightly larger than the maximum distance W2 (FIG. 7) between two adjacent prongs 5*a*, the prongs 5*a* are held firmly in the retainer 26' without wobbling.

Figure 10:
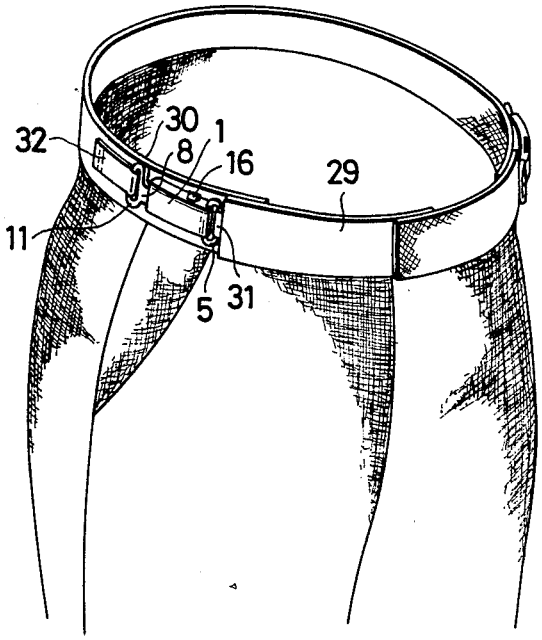
FIG. 10 is a perspective view of the adjustable fastener shown in FIG. 6 as the fastener is attached to a waistband of a pair of trousers.

When the adjustable buckle shown in FIGS. 1 through 6 is to be attached to a pair of trousers for adjusting the effective length of a waistband, as shown in FIG. 10, the C-shaped ring connector 5 of the sleeve 1 is connected to a first belt or strap 31 secured by sewing stitches to an upper part 29 of the waistband, while the C-shaped ring connector 11 of the plug 8 is connected to a second belt or strap 32 secured by sewing stitches to a lower part 30 of the waistband, The adjustable buckle thus attached operates as follows. The push head 18 of the locking member 16 is pushed by the user's finger against the force of the spring 23 to cause the locking saw-teeth 19 to disengage from the saw-teeth 12 on the plug 8. While keeping the depressed condition of the locking member 16, the plug 8 is moved along the guide channel 4 toward a desired position in the sleeve 1. Upon arrival to the desired position, the user releases the locking member 16 so that the locking member 16 is automatically returned to its normal position under the force of the spring 23. Thus, the locking saw-teeth 19 on the locking member 16 again engage the saw-teeth 12 on the plug 8 thereby holding the plug 8 in position against movement relative to the sleeve 1.

Figure 11:
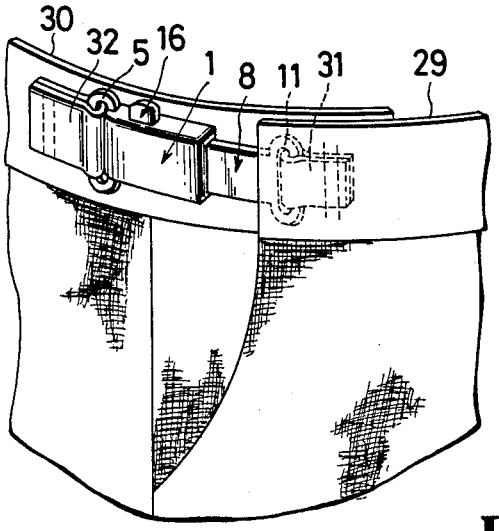
FIG. 11 is a view similar to FIG. 10, but showing a different manner of application of the adjustable fastener according to the present invention.

The adjustable buckle may be attached to the waistband in a different manner such as shown in FIG. 11, in which the C-shaped ring connector 5 of the sleeve 1 is connected to the second strap 32 while the C-shaped ring connector 11 of the plug 8 is connected to the first strap 31. In this instance, the pusher head 17 (FIG. 1) of the locking member 16 is disposed outside of the sleeve 1. This arrangement is achieved by displacing the spring 23 from the recess 21 to the recess 22 in the locking member 16 and placing the stopper 24 adjacent to the pusher head 18.

Figure 12:
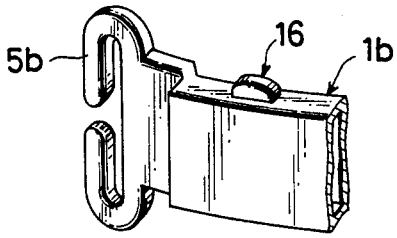
FIG. 12 is a fragmentary perspective view of a sleeve of the adjustable fastener having a modified connecting portion.
Figure 13:
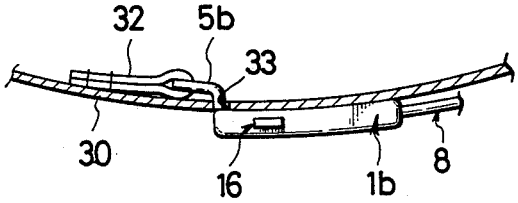
FIG. 13 is a plan view, with part in cross section, of the adjustable fastener shown in FIG. 12, illustrative of the manner in which the fastener is attached to a waistband.

FIGS. 12 and 13 show a modified sleeve 1*b* having a stepped C-shaped ring connector 5*b* extending in a place which is offset outwardly from the back plate of the sleeve 1*b*. For attachment, the stepped C-shaped ring connector 5*b* passes through a slit 33 in the lower part 30 of the waistband from the front side to the rear side of the lower part 30. When the socket 1*b* is used in combination with the plug 8 shown in FIG. 10, the connecting portions 5, 11 are concealed by the lower and upper parts of 30, 29 of the waistband, with the result that the overall appearance of the adjustable fastener is improved.

As described above, the adjustable fastener composed of a thin flat sleeve 1 and a flat plug 8 slidably received therein is low in profile and sightly in appearance. Furthermore, the plug 8 and the locking member 16 received in the sleeve 1 are substantially free from damage. The adjustable fastener is rigid enough to withstand force and pressure applied when ironing of the trousers. With the provision of two rows of saw-teeth 12, 13, two rows of locking saw-teeth 19, 20, two recesses 21, a stopper 24 structurally separated from the sleeve 1, the mode of application of the adjustable fastener can be changed only by changing the position of the spring 23 and the stopper 24. This arrangement is particularly useful when two adjustable fasteners are attached to the waistband at diametrically opposite portions thereof, with the respective locking members partly projecting outwardly of the corresponding sleeve in the same direction. When the trousers or the other article is subjected to cleaning, the adjustable fastener having C-shaped ring connectors 5, 11 can be detached from the the article by removing looped portions of the respective straps 31, 32 from the C-shaped ring connectors 5, 11.

Obviously, various modifications and variations of the present invention are possible in light of the above teaching. It is therefore to be understood that within the scope of the appended claims the invention may be practiced otherwise than as specifically described.

What is claimed is:

1. An adjustable fastener for interconnecting a first part and a second part, comprising:

(a) a flat hollow sleeve having a longitudinal guide channel extending from an end of said sleeve, a guide groove extending transversely of and opening to the guide channel, and a first connecting portion for attachment to the first part;

(b) a plug having a flat body slidably receivable in said guide channel, a row of teeth disposed on and extending along a longitudinal edge of said body, and a second connecting portion disposed at an end of said body for attachment to the second part;

(c) a locking member slidably held within said guide groove and having a pusher head at an end thereof, and at least one locking projection releasably engageable with one of said teeth on said plug body for locking said plug in position against displacement; and (d) spring means held within said sleeve for normally retaining said locking projection in locking engagement with said one of said teeth and keeping said pusher head to project outwardly of said sleeve, said locking member being movable along said guide groove to disengage said locking projection from said one of said teeth against the force of said spring means when said pusher head is depressed.

2. An adjustable fastener according to claim 1, said locking member having a recess extending from an opposite end thereof and terminating short of said one end of said locking member, said spring means comprising a compression coil spring disposed within said recess.

3. An adjustable fastener according to claim 1, said teeth on said plug comprising saw-teeth each having a straight edge extending transverse to the direction of movement of said plug, and an inclined edge facing in a direction away from said one end of said sleeve, said locking projection on said locking member comprising a saw tooth complementary in contour to said saw-teeth on said plug.

4. An adjustable fastener according to claim 1, one of said sleeve and said plug having a guide recess extending parallel to the direction of movement of said plug, the other of said sleeve and said plug including a stopper projection slidably received in said guide recess for holding the sleeve and said plug in an assembled condition against accidental detachment.

5. An adjustable fastener according to claim 1, said connecting portion of said sleeve comprising a substantially C-shaped ring connector disposed at an opposite end of said sleeve, said connecting portion of said plug comprising generally C-shaped ring connector.

6. An adjustable fastener according to claim 1, said connecting portion of said sleeve comprising a plurality of prongs projecting from the underside of said sleeve for piercing the one part, said connecting portion of said plug comprising a substantially C-shaped ring connector, further including a retainer to which said prongs are clinched with the one part disposed between said sleeve and said retainer.

7. An adjustable fastener according to claim 6, said retainer having a plurality of openings for the passage therethrough of the respective prongs when said prongs are clinched with said retainer.

8. An adjustable fastener according to claim 6, said retainer having a hollow construction having an internal slot and a pair of inclined guide flaps disposed adjacent to opposite open ends of said slot or guiding said prongs into said slot when said prongs are clinched with said retainer.

9. An adjustable fastener for interconnecting a first part and a second part, comprising:

(a) a flat hollow sleeve having a longitudinal guide channel extending from an end of said sleeve, a guide groove extending transversely of and opening to the guide channel, and a first connecting portion for attachment to the first part;

(b) a plug having a flat body slidably receivable in said guide channel, first and second rows of teeth disposed on and extending along opposite longitudinal edges of said body, and a second connecting portion disposed at an end of said body for attachment to the second part;

(c) a locking member slidably held within said guide groove and having first and second pusher heads at opposite ends thereof, and first and second locking projections disposed adjacent to said first and second pusher heads, respectively, and releasably engageable with said first and second teeth, respectively, on said plug body for locking said plug in position against displacement; and (d) spring means held within said sleeve for normally retaining one of said first and second locking projections in locking engagement with a corresponding one of said first and second teeth and keeping one of said first and second pusher heads to project outwardly of said sleeve, said locking member being movable along said guide groove to disengage said one locking projection from said one of said teeth against the force of said spring means when said one pusher head is depressed.

10. An adjustable fastener according to claim 9, said teeth on said plug comprising saw-teeth each having a straight edge extending transverse to the direction of movement of said plug, and an inclined edge facing in a direction away from said one end of said sleeve, said locking projection on said locking member comprising a sew-tooth complementary in contour to said saw-teeth on said plug.

11. An adjustable fastener according to claim 9, one of said sleeve and said plug having a guide recess extending parallel to the direction of movement of said plug, the other of said sleeve and said plug including a stopper projection slidably received in said guide recess for holding the sleeve and said plug in an assembled condition against accidental detachment.

12. An adjustable fastener according to claim 9, said connecting portion of said sleeve comprising a substantially C-shaped ring connector disposed at an opposite end of said sleeve, said connecting portion of said plug comprising generally C-shaped ring connector.

13. An adjustable fastener according to claim 9, said connecting portion of said sleeve comprising a plurality of prongs projecting from the underside of said sleeve for piercing the one part, said connecting portion of said plug comprising a substantially C-shaped ring connector, further including a retainer to which said prongs are clinched with the one part disposed between said sleeve and said retainer.

14. An adjustable fastener according to claim 13, said retainer having a plurality of openings for the passage therethrough of the respective prongs when said prongs are clinched with said retainer.

15. An adjustable fastener according to claim 13, said retainer having a hollow construction having an internal slot and a pair of inclined guide flaps disposed adjacent to opposite open ends of said slot for guiding said prongs into said slot when said prongs are clinched with said retainer.

16. An adjustable fastener according to claim 9, said locking member having a first recess extending from one end thereof and terminating short of an opposite end of said locking member and a second recess extending from said opposite end and terminating short of said one end of said locking member, said spring means comprising a compression coil spring disposed within one of said first and second recesses.

17. An adjustable fastener according to claim 9, further including a stopper disposed within said guide groove adjacent to the other of said first and second pusher heads and engage abe with said locking member to limit the movement of the same for preventing the other first and second rods of locking projections from engaging with the other of said teeth when said one pusher head is depressed.

* * * * *